US007178490B2

(12) United States Patent
Bauer et al.

(10) Patent No.: US 7,178,490 B2
(45) Date of Patent: Feb. 20, 2007

(54) DEVICE FOR HYDRAULIC VALVE LIFT SWITCHING

(75) Inventors: Erwin Bauer, Regensburg (DE); Dietmar Ellmer, Regensburg (DE); Achim Koch, Tergernheim (DE); Thorsten Lauer, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 247 days.

(21) Appl. No.: 10/852,653

(22) Filed: May 25, 2004

(65) Prior Publication Data

US 2005/0005882 A1 Jan. 13, 2005

(30) Foreign Application Priority Data

May 26, 2003 (DE) ..... 103 23 877

(51) Int. Cl.
*F01L 9/02* (2006.01)

(52) U.S. Cl. ..... 123/90.12; 123/90.13; 123/90.15; 251/129.1; 251/129.16

(58) Field of Classification Search ..... 123/90.12, 123/90.13, 90.15; 251/129.1, 129.16
See application file for complete search history.

(56) References Cited

U.S. PATENT DOCUMENTS 6,092,495 A * 7/2000 Hackett ..... 123/90.15

FOREIGN PATENT DOCUMENTS

JP 02042107 A 2/1990

OTHER PUBLICATIONS

Der neue Motor des Porsche 911 Turbo, MTZ Motortechnische Zeitschrift 61, 2001, pp. 730-743.

* cited by examiner

*Primary Examiner*—Thomas Denion
*Assistant Examiner*—Zalalem Eshete
(74) *Attorney, Agent, or Firm*—Morrison & Foerster LLP

(57) ABSTRACT

The invention relates to a device for electrohydraulic valve lift switching with a hydraulically activatable actuating element for bringing about valve lift switching, which is connected to an oil line, whereby the action of pressurized oil on the actuating element can be controlled by an on/off valve arranged in the oil line and connected to a control device. The invention has an oil pressure metering device arranged in the oil line, which is connected to the control device, and a device for detecting the time period between activation of the on/off valve by the control device and a characteristic change in the measured oil pressure.

10 Claims, 2 Drawing Sheets

DEVICE FOR HYDRAULIC VALVE LIFT SWITCHING

CLAIM FOR PRIORITY

This application claims the benefit of priority to German Application No. 103 23 877.8, filed on May 26, 2003 in the German language, the contents of which are hereby incorporated by reference.

TECHNICAL FIELD OF THE INVENTION

The invention relates to a device for electrohydraulic valve lift switching.

BACKGROUND OF THE INVENTION

Such devices for electrohydraulic valve lift switching are deployed in modern internal combustion engines, to adjust the operation of the engine to the respective operating situation, so that engine power, fuel consumption or emission response can be optimized as a function of the operating situation. The aim is to reduce fuel consumption and emissions when the power requirement is low but otherwise to make maximum engine power available. An engine equipped thus is for example known from the article "Der neue Motor des Porsche 911 Turbo" (The new Porsche 911 Turbo engine", MTZ Motortechnische Zeitung 61 (2000) 11, pages 730 to 743.

In the case of engines with electrohydraulic valve lift switching however not only is the valve lift switched but numerous engine control parameters are also changed. For an optimum effect it is of essential importance for all parameters to be coordinated in respect of each other and to be adjusted when a valve lift switch is effected. The time of the valve lift switch also has to be coordinated with the time of the other parameter changes. The problem arises here that the precise time of the valve lift switch is not known. It is known when a corresponding control signal is emitted but not the time when the valve lift switch is actually effected. One significant uncertainty factor when determining this time is the on/off valve, the switch response of which depends on temperature, oil pressure and many other influencing variables, which can in turn depend on the arrangement of the on/off valve within the engine. A precise conclusion about the switch time of the on/off valve or the occurrence of th e valve lift switch cannot therefore be obtained from the time of activation of the on-off valve. It cannot therefore be ensured that optimum coordination of the valve lift switch and other engine control parameters is achieved under all operating conditions.

It is known from the prior art that valve lift switching can be identified by means of a valve lift sensor. However this is relatively complex and expensive.

SUMMARY OF THE INVENTION

The invention relates to a device for electrohydraulic valve lift switching with a hydraulically activatable actuating element for bringing about valve lift switching, which is connected to an oil line, whereby the action of pressurized oil on the actuating element can be controlled by an on/off valve arranged in the oil line, and connected to a control device.

The invention discloses a device for electronic valve lift switching, with which the time when the valve lift switch is effected can be determined more precisely but which is still economical.

In one embodiment of the invention, there is a device in which an oil pressure metering device arranged in the oil line is provided, which is connected to the control device and a device is also provided for detecting the time period between activation of the on/off valve by the control device and a characteristic change in the measured oil pressure.

The inventive device utilizes the knowledge that a characteristic change in oil pressure takes place when the actuating element is activated. This is a brief pressure trough after the valve movement caused by the fact that after the on/off valve opens, a defined volume of oil flows to or into the actuating element. This pressure pattern can be measured by the oil pressure metering device and converted to an electrical signal proportional to pressure, which is sent to the control device. As the general pressure pattern during a valve lift switch is known, the measured pressure pattern can be used to identify the existence of a valve lift switch in a reliable manner.

The time between activation of the on/off valve by the control device and identification of a characteristic pattern of the measured oil pressure is analyzed by the control device or the engine control device. The coordination in respect of time of further valve lift switching processes can therefore be adjusted.

In a preferred embodiment, the oil pressure metering device is arranged on the supply side of the on/off valve.

It is also advantageous for the control device or the engine control device to see whether a pressure change or awaited characteristic pressure pattern has taken place and thereby to identify whether or not a switching process has taken place in the on/off valve.

In one advantageous embodiment of an inventive device for electrohydraulic valve lift switching, the on/off valve can be activated electrically. In an alternative embodiment, an additional pressure generator is provided, which can be activated by the control device and for its part activates the on/off valve hydraulically or pneumatically.

In a simple and therefore economical embodiment, the on/off valve is connected on the supply side to an engine oil circulation system. The actuating element is therefore activated via the standard engine oil and no additional hydraulic circuit is required.

BRIEF DESCRIPTION OF THE DRAWINGS

The invention is described in more detail below with reference to exemplary embodiments in the figures, in which.

DETAILED DESCRIPTION OF THE INVENTION

Figure 1:
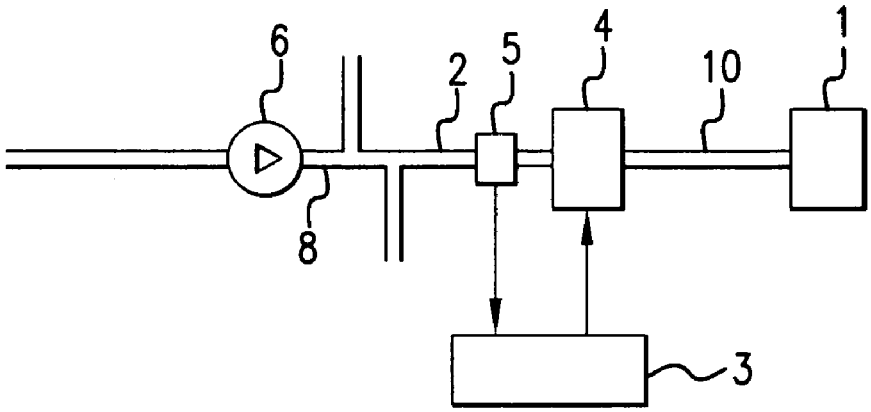
FIG. 1 shows a schematic representation of an inventive device for electrohydraulic valve lift switching with an electrically activatable on/off valve.

FIG. 1 shows the inventive device for electrohydraulic valve lift switching connected to the standard engine oil circulation system 8 of an internal combustion engine. An oil pump 6 pumps oil into a line network, to which an oil line 2 is also connected, which runs to the device for valve lift switching. The oil line 2 is thereby fed to the supply side of an on/off valve 4. On the output side the on/off valve 4 is connected to an actuating element 1, which brings about the actual valve lift switch. Depending on the operating state of the engine, the switch is made between a short and a long valve lift. Both the intake and outlet valves of the engine (not shown here in greater detail) can be activated in this process. The actual switching process is effected for example with switching tappets.

The on/off valve 4 is activated by a control device 3 by means of an electrical signal. On activation the on/off valve 4 opens and the pressurized oil in the oil line 2 on the supply side can therefore act on the actuating element 1. Displacement of an activation element in the actuating element 1 on the one hand brings about the valve lift switch, on the other hand oil has to follow from the oil line 2. This causes a short-term drop in oil pressure, from which it can be identified that a valve lift switch has taken place. The characteristic change in the measured oil pressure is advantageously detected on the supply side of the on/off valve 4 by an oil pressure metering device 5 and reported to the control device 3. The control device 3 analyzes the measured pattern of the oil pressure and is thereby able to detect and further process the time period between activation of the on/off valve 4 and the occurrence of a characteristic oil pressure change.

It would also be possible to arrange the oil pressure metering device 5 in a control section 10 of the oil line 2, located between the on/off valve 4 and the actuating element 1. However measurement is more complex, as when the on/off valve switches, the oil pressure in the control section 10 first increases and the short-term drop in pressure only occurs after movement of the activation element in the actuating element 1.

With an exemplary embodiment according to FIG. 1 the control device 3 is set up so that it uses differences between the switch time as determined and a target value automatically to correct future activation processes.

Figure 2:
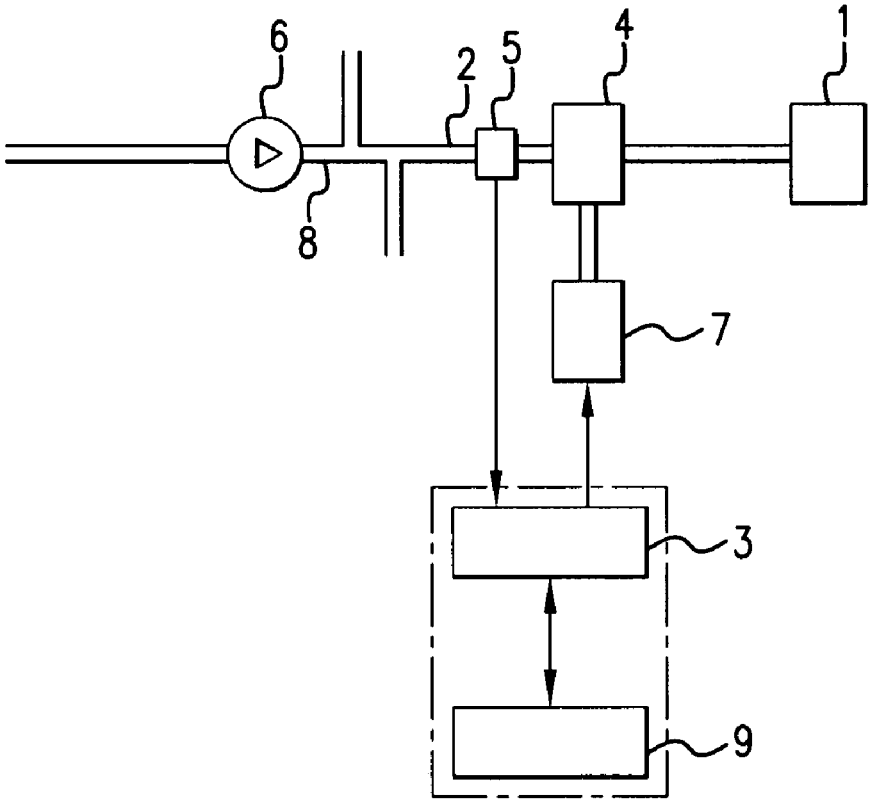
FIG. 2 shows a schematic representation of an inventive device for electrohydraulic valve lift switching with a hydraulically activatable on/off valve.

With the embodiment according to FIG. 2, the control device 3 is connected to an engine control device 9, which also controls other operating parameters of the internal combustion engine. This means that it is possible for the change in the operating parameters of the engine and the valve lift switch to be coordinated already in an optimum manner in the engine control system 9. This relates for example to adjustment of the control variables of the throttle valve angle, the ignition angle or what is known as injection and cam phasing. The control device 3 and the engine control device 9 can thereby be configured as one unit, so that the control device 3 only forms one function group within the engine control device 9.

A further difference between the device in FIG. 2 compared with the device in FIG. 1 is the activation of the on/off valve 4. While the on/off valve in the arrangement in FIG. 1 is electrically activatable, the on/off valve in FIG. 2 is hydraulically activatable. The control device 3 acts on a separate pressure generator 7, which activates the on/off valve 4 via a hydraulic line.

Figure 3:
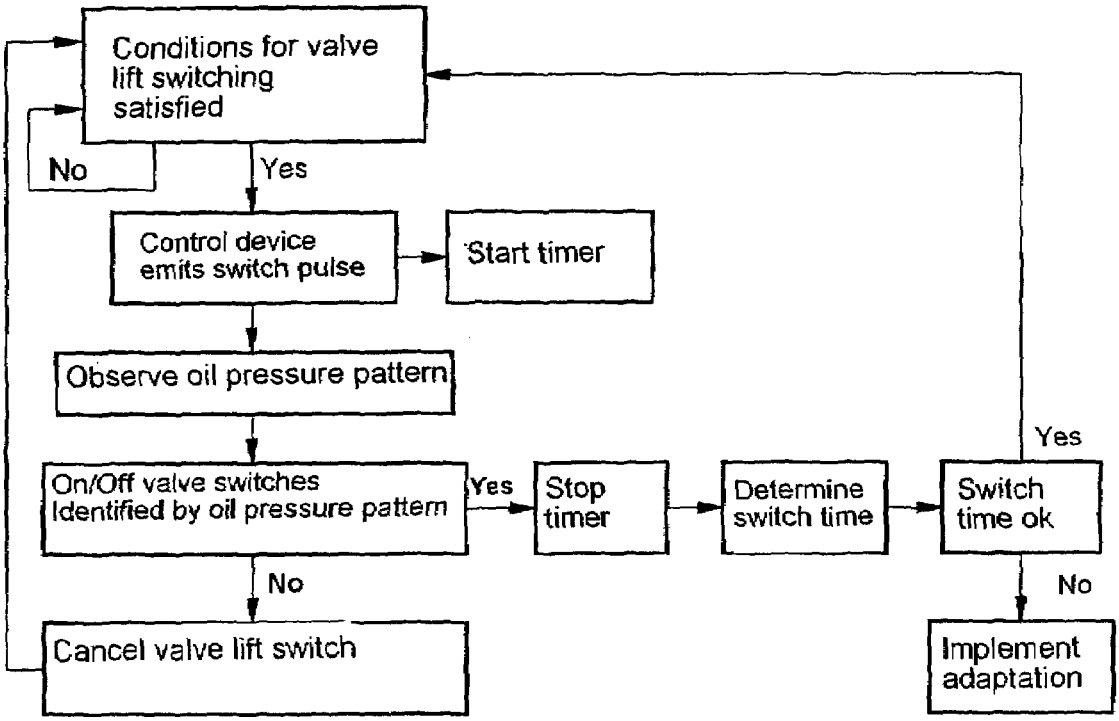
FIG. 3 shows a flow diagram of the control system of a device according to FIG. 1 or FIG. 2.

FIG. 3 shows a flow diagram of the valve lift s witch control system. If predefined conditions for valve lift switching are satisfied, the control device 3 sends a switching signal either electrically or hydraulically to the on/off valve 4. A timer is started at the same time. The oil pressure pattern measured by the oil pressure metering device 5 is then observed. After the on/off valve has switched, a characteristic change in the oil pressure pattern is identified.

If such a positive identification is made, the timer is stopped and the switch time is determined from the timer reading. If the switch time is within a predefined tolerance range, the existence of predefined conditions for repeat valve lift switching is awaited.

Otherwise coordination of the valve lift switch in respect of time is adapted based on the change in other parameters.

In the event that no characteristic change is identified in the oil pressure pattern, even though a switch operation should have taken place in the on/off valve 4, i.e. a corresponding switch signal was generated, the valve lift switch is "canceled", which means that the parallel change in other engine control parameters is canceled. The existence of conditions for valve lift switching is then awaited again.

Figure 4:
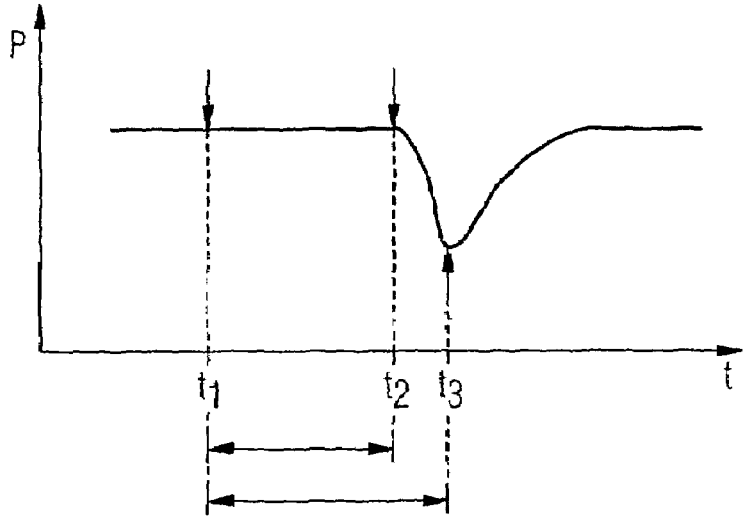
FIG. 4 shows a diagram of a measured oil pressure pattern curve with a change in the measured oil pressure that is characteristic of a valve lift switch.

FIG. 4 shows the pattern over time of the measured oil pressure with reference to an exemplary curve. The measured oil pressure is shown on the vertical axis. At time $t_1$ the control device 3 sends a switch pulse to the on/off valve 4. At time $t_2$ the hitherto constant oil pressure drops. The time period between $t_1$ and $t_2$ is referred to as the response time $T_a$. The oil pressure then drops further, until it reaches a minimum at a time $t_3$. The time period between times $t_1$ and $t_3$ is referred to as the switch time $T_s$. The oil pressure then rises again, until it reaches its initial level.

The time period $T_s$ therefore refers to the time period from emission of the switch pulse for the on/off valve 4 to completion of the switching process. This represents important information for the control device 3 or the engine controller 9, as it provides knowledge about the response in respect of time of the control distance, which is of major significance for regulatory intervention in particular. The decisive factor in this context is the time, at which the switch pulse has to be emitted, so that switching takes place at a defined time in the future. Also detection of the switch time allows the long-term response of the system to be detected and the changed initial conditions can therefore be taken into account during valve lift switching processes.

If the awaited pressure pattern does not manifest itself, this means that a valve lift switch is not taking place or has not taken place and the measures already taken parallel to the valve lift switch can be canceled, as set out above. This relates for example to adjustment of the control variables of the throttle valve angle, the ignition angle or injection and cam phasing, which are quickly canceled.

The switch time $T_s$ does not directly give the time at which the valve lift switch is effected but the biggest uncertainty factor, namely the switch time $T_s$, can be directly detected and differences can be compensated for.

What is claimed is:

1. A device for electrohydraulic valve lift switching, comprising:

an oil line to feed the supply side of an on/off valve, wherein the on/off valve is connected on an output side to a hydraulically activatable actuating element to cause valve lift switching, whereby an action of pressurized oil on the actuating element is configured to be controlled by the on/off valve, the on/off valve being and connected to a control device for activation; and an oil pressure metering device being arranged in the oil line, and connected to the control device to detect a short-term drop in oil pressure in the oil line and to report the short term drop in the oil pressure to the control device, wherein the control device is configured to identify that a valve lift switch has taken place, and to detect a switch time period between activation of the on/off valve by the control device and the short-term drop in oil pressure, and wherein the control device is configured to use differences between the determined switch time and a target value to adapt a timing of the valve lift switching.

2. The device according to claim 1, wherein the oil pressure metering device is arranged on a supply side of the on/off valve.

3. The device according to claim 1, wherein the on/off valve is electrically activatable.

4. The device according to claim 1, wherein the on/off valve is hydraulically or pneumatically activatable.

5. The device according to claim 1, wherein the on/off valve is connected to an engine oil circulation system on a supply side.

6. Device according to claim 1, wherein the control device is connected to an engine control device.

7. An internal combustion engine, comprising:

a device for electrohydraulic valve lift switching having an oil line to feed the supply side of an on off valve, wherein the on/off valve is connected on an output side to a hydraulically activatable actuating element to cause valve lift switching, whereby an action of pressurized oil on the actuating element is controlled by the on/off valve which is connected to a control device for activation; and an oil pressure metering device being arranged in the oil line, and being connected to the control device to detect a short-term drop in oil pressure in the oil line and to report this short-term drop in oil pressure to the control device.

wherein the control device is configured to identify that a valve lift switch has taken place, and to detect a switch time period between activation of the on/off valve by the control device and the short-term drop in the oil pressure, and wherein the control device is configured to use differences between the determined switch time and a target value to adapt a timing of the valve lift switching.

8. The internal combustion engine according to claim 7, wherein the control device is set up to report a detected time period to the engine control device.

9. The internal combustion engine according to claim 7, wherein the control device reports to the engine control device when no characteristic oil pressure change has been measured in a predefined time period despite activation of the on/off valve.

10. The internal combustion engine according to claim 7, wherein the control device and the engine control device form a unit.

* * * * *